United States Patent [19]

Herron, Jr.

[11] Patent Number: 4,945,603

[45] Date of Patent: Aug. 7, 1990

[54] FRONT CASTER ASSEMBLY FOR CANISTER VACUUM CLEANER

[75] Inventor: Roy H. Herron, Jr., Starr, S.C.

[73] Assignee: Ryobi Motor Products Corp., Pickens, S.C.

[21] Appl. No.: 261,626

[22] Filed: Oct. 24, 1988

[51] Int. Cl.[5] ..... A47L 9/00

[52] U.S. Cl. ..... 15/323; 15/327.1; 16/23

[58] Field of Search ..... 16/20, 22, 23; 15/327 F, 323

[56] References Cited

U.S. PATENT DOCUMENTS

| | | | |
|---|---|---|---|
| 355,020 | 12/1886 | Lamb | 16/23 |
| 2,810,925 | 10/1957 | Meyerhoefer | 16/18 |
| 3,003,179 | 10/1961 | Descarries | 15/327 |
| 3,401,952 | 9/1968 | Johanson et al. | 280/150 |
| 4,509,227 | 4/1985 | Keane | 15/327 F X |
| 4,658,465 | 4/1987 | Keane et al. | 15/323 |

*Primary Examiner*—Chris K. Moore
*Attorney, Agent, or Firm*—David L. Davis

[57] ABSTRACT

A front caster assembly for a canister-type vacuum cleaner includes a swivel body member mounted for pivotal movement to the underside of the vacuum cleaner casing. A caster wheel is mounted on the underside of the swivel body member for rolling contact with the floor. A pair of small idler wheels are snap-fit onto the upper surface of the swivel body member, each having its rotational axis offset approximately 45 degrees from the line of rotation of the caster wheel, with the rotational axes intersecting at the pivot axis of the swivel body member. The idler wheels contact the underside of the vacuum cleaner casing to act as low friction bearings for pivoting movement of the swivel body member. The swivel body member is formed with an elongated flat portion removed from its pivot axis which serves as part of the cord wrap structure for the vacuum cleaner.

4 Claims, 2 Drawing Sheets

FRONT CASTER ASSEMBLY FOR CANISTER VACUUM CLEANER

BACKGROUND OF THE INVENTION

This invention relates to vacuum cleaners and, more particularly, to a caster assembly for a canister vacuum cleaner which also functions as part of the cord wrap structure for the electric line cord of the vacuum cleaner. Canister vacuum cleaner casings typically are provided with a pair of fixed axis rear wheels and a pivoting front caster assembly, including a caster wheel, to allow the vacuum cleaner casing to be pulled by means of the hose which extends out from its front end. The front caster assembly is free to pivot about an axis to allow for changes in direction of the pulling motion. Examples of such caster structure may be found in U.S. Pat. No. 2,810,295 to Meyerhoefer, U.S. Pat. No. 3,003,179 to Descarries and U.S. Pat. No. 3,410,952 to Johanson et al. In all of those caster assemblies, ball bearings are provided to allow the caster assembly to pivot about an axis transverse to the lower surface of the canister vacuum cleaner casing. Additionally, the line of rotation of the caster wheel passes through the pivot axis of the caster assembly and the rotational axis of the caster wheel is offset from the pivot axis, so that the caster wheel tends to move to the rear relative to the pivot axis when the vacuum cleaner casing is moved in a forward direction.

The known prior art caster assemblies suffer from a number of disadvantages. First, the use of ball bearings increases the number of parts and the subsequent cost of the assembly. Further, assembling and installing the caster assembly is complicated and time consuming, again increasing the cost. It is therefore a primary object of the present invention to provide an improved caster assembly with a reduced number of parts and increased ease of assembly.

Vacuum cleaners are operated by means of electrical power. With the exception of battery powered units, vacuum cleaners have an electrical line cord which extends out from the vacuum cleaner casing, typically from the rear thereof, for connection to an electrical power outlet. The higher priced units may have a retractable cord reel for storage of the electrical line cord when the vacuum cleaner is not in use. Lower priced models are provided with cord wraps about which the electrical line cord is wound for storage purposes. These additional elements increase the cost of the vacuum cleaner. It is therefore a further object of the present invention to utilize the caster assembly as part of the cord wrap structure.

SUMMARY OF THE INVENTION

The foregoing and additional objects are attained in accordance with the principles of this invention by providing a caster assembly for a vacuum cleaner casing comprising a body member, means for mounting the body member on a substantially planar lower surface of the casing, the mounting means being arranged to allow pivoting movement of the body member relative to the casing about an axis transverse to the lower surface, a caster wheel mounted for rotation on the body member and for rolling contact with a floor surface supporting the vacuum cleaner casing, the line of rotation of the caster wheel passing through the pivot axis, the rotational axis of the caster wheel being spaced from the pivot axis and substantially parallel to the lower surface, and a pair of idler wheels mounted for rotation on the body member and for rolling contact with the lower surface of the casing, the axes of rotation of the idler wheels intersecting at the pivot axis.

In accordance with a feature of the present invention, the axes of rotation of the idler wheels are equiangularly spaced on opposite sides of the caster wheel line of rotation.

In accordance with another feature of this invention, the angle between the axes of rotation of the idler wheels is about 90 degrees.

In accordance with yet another feature of this invention, the angle between the axes of rotation of the idler wheels is 84 degrees.

In accordance with still another feature of this invention, each of the idler wheels includes an axle and the body is formed with a plurality of spaced walls formed with axle receiving slots, each of the slots being shaped with sides which taper inwardly to a generally circular region so as to provide for a snap-fit insertion of the idler wheel axles.

In accordance with a further feature of this invention, the body is formed with an extension beyond the caster wheel from the pivot axis, the extension being spaced from the lower surface and shaped to provide a wrap tongue for the electric line cord of the vacuum cleaner.

BRIEF DESCRIPTION OF THE DRAWINGS

The foregoing will be more readily apparent upon reading the following description in conjunction with the drawings wherein.

DETAILED DESCRIPTION

Figure 1:
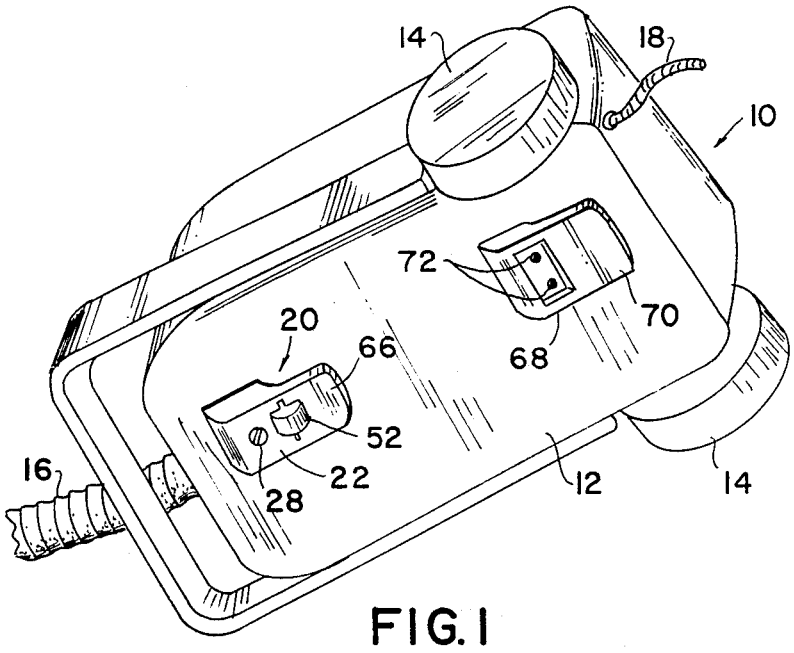
FIG. 1 is a perspective view of the underside of a canister vacuum cleaner showing the caster assembly according to this invention when it is functioning as a caster wheel.

Referring now to the drawings, wherein like elements in different figures thereof have the same reference numeral applied thereto, FIG. 1 shows the underside of a canister vacuum cleaner casing 10 having a substantially planar lower surface 12 and a pair of rear wheels 14. The wheels 14 are mounted for rotation about a single fixed axis (not shown), as is conventional in the art. A hose 16 extends outwardly from the forward, or front, end of the casing 12 and, as is well known, is used as a conduit for dirt laden air which is drawn into casing 10 by an internal motor-blower unit (not shown). The hose 16 is also utilized for pulling the casing 10 as the operator moves about. An electric line cord 18 extends out from the rear of the casing 10 for connection to a conventional electric wall outlet to supply power to the internal motor-blower unit of the vacuum cleaner. All of the foregoing is part of a conventional canister-type vacuum cleaner and is well known to those of ordinary skill in the art.

Figure 3:
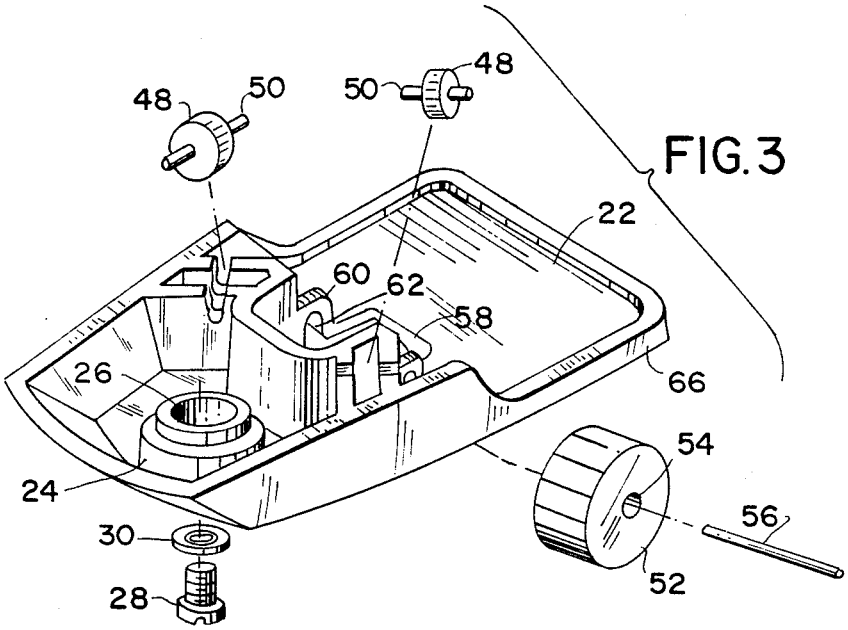
FIG. 3 is an exploded perspective view of the caster assembly of the present invention.

In accordance with the principles of this invention, the vacuum cleaner casing 10 has mounted thereon a front caster assembly, designated generally by the reference numeral 20, and constructed in accordance with the principles of this invention. The main component of the front caster assembly 20 is the swivel, or body member 22, more clearly shown in FIGS. 3, 4 and 5. The body member 22 is preferably formed as a unitary molded plastic piece, being so configured as to perform a number of functions. Thus, the body member 22 is adapted to be pivotally mounted on the substantially planar lower surface 12 of the casing 10. To this end, the body member 22 is formed with a tower 24 having a central opening 26. A threaded bolt 28 extends through the central opening 26 of the tower 24 and into an appropriate internally threaded opening (not shown) in the lower surface 12 to mount the body member 22 thereon while still allowing pivoting motion thereof about the axis defined by the central axis of the bolt 28, which is transverse to the surface 12. The washer 30, installed between the head of the bolt 28 and the body member 22 provides a relatively low friction bearing surface for the bolt head.

Figure 6:
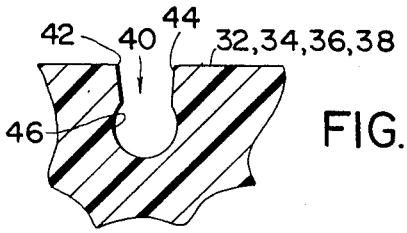
FIG. 6 is a detail of the snap area for accepting the idler wheel axles.

To allow for the free pivoting movement of the body member 22 about the axis of the bolt 28, the body member 22 is formed with a plurality of spaced walls 32, 34, 36, and 38. As shown in greater detail in FIG. 6, each of the walls 32, 34, 36, 38 is formed with a slot 40 having inwardly tapering sides 42 and 44 which extend to a generally circular region 46 of enlarged dimension. The walls 32–38 and slots 40 provide mounting structure for a pair of idler wheels 48, which are preferably unitary plastic moldings including axles 50. The spacing between the walls 32, 34 and 36, 38, and the sizing of the slots 40 relative to the axles 50 is such that the idler wheels 48 may be inserted into the body member 22 in a snap-fit manner, with the clearance between the circular regions 46 and the axles 50 being sufficient to allow the idler wheels 48 to rotate freely after insertion. When the body member 22, with the idler wheels 48 installed, is mounted to the lower surface 12 of the casing 10 by means of the bolt 28, the idler wheels 48 are in rolling contact with the surface 12. As is clearly shown in FIG. 4, the axes of rotation of the idler wheels 48 intersect at the center of the central opening 26, which is the pivoting axis of the body member 22. Accordingly, the idler wheels 48 roll tangentially to a circle having the pivot axis as its center and therefore function as low friction bearings for the swiveling movement of the caster assembly 20.

To complete the caster assembly 20, a caster wheel 52 is provided. The caster wheel 52 is has a central opening 54 defining its axis of rotation and so sized to accommodate therethrough an axle pin 56. The body member 22 is formed with an elongated opening 58 sized to allow the caster wheel 52 to fit therein with sufficient clearance that there is no contact between the wheel 52 and the edges of the opening 58. Flanking the opening 58 are a pair of walls 60 having snap-fit slots 62 to capture the axle pin 56. Thus, when so installed, the caster wheel 50 rolls along the floor when the vacuum cleaner casing 10 is in its operative, upright position.

Figure 4:
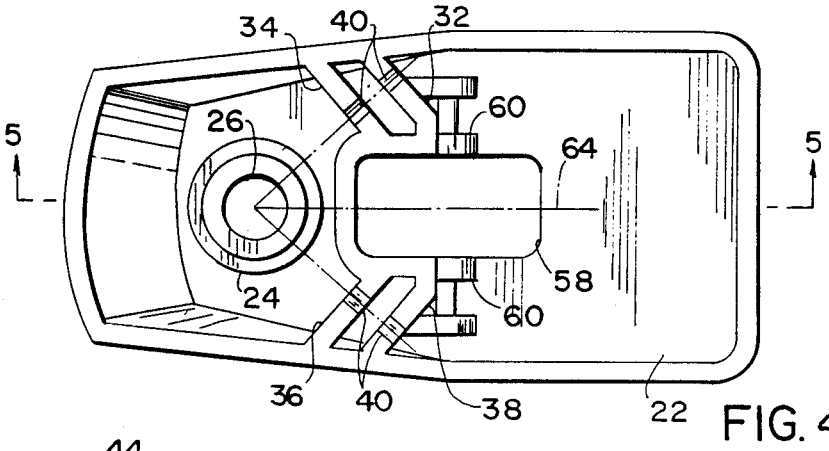
FIG. 4 is a top plan view of the body member of the caster assembly of this invention.
Figure 5:
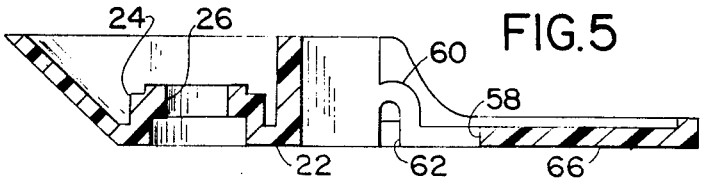
FIG. 5 is a cross-sectional view of the body member taken along the line 5—5 of FIG. 4.

As is apparent from FIG. 4, the line of rotation 64 of the caster wheel 52 passes through the pivot axis of the caster assembly 20. Also, the axis of rotation of the caster wheel 52 is spaced from that pivot axis and is substantially parallel to the lower surface 12. Accordingly, as the vacuum cleaner is pulled along the floor, the front caster assembly swivels to allow the caster wheel 52 to follow the pivot axis, as is conventional in the caster art. FIG. 4 shows that the angle between the rotational axes of the idler wheels 48 is about 90 degrees and these axes of rotation are equiangularly spaced on opposite sides of the caster wheel line of rotation 64. Preferably, the angle between the axes of rotation of the idler wheels is 84 degrees.

As mentioned above, the front caster assembly 20 performs a function in addition to that of a caster. This additional function is to act as part of the cord wrap structure for the vacuum cleaner Toward that end, the body member 22 of the caster assembly 20 is formed with an extension portion 66. The extension portion 66 is generally broad and flat and is spaced from, and substantially parallel to, the lower surface 12 of the vacuum cleaner casing 10. The other part of the cord wrap structure is the fixed cord wrap 68 which is of the same general configuration as the body member 22. The fixed wrap 68 is formed with a generally broad and flat tongue-like extension 70 which is spaced from, and substantially parallel to, the lower surface 12, similar to the extension portion 66. The fixed wrap 68 is secured to the lower surface 12 by means of threaded screws 72 or the like.

Figure 2:
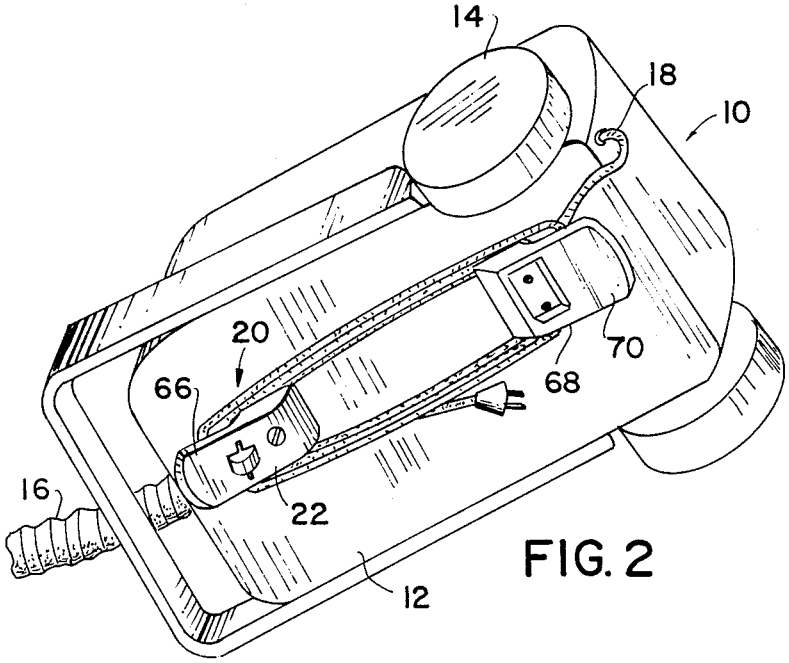
FIG. 2 is a perspective view of the underside of a canister vacuum cleaner showing the caster assembly according to this invention when it is functioning as part of the cord wrap structure of the vacuum cleaner.

As shown in FIG. 1, when the vacuum cleaner is in use, the body member 22 of the front caster assembly 20 and the fixed cord wrap 68 are similarly oriented. However, as shown in FIG. 2, when it is desired to secure the electric line cord 18 for storage of the vacuum cleaner during periods of non-use, the body member 22 of the front caster assembly 20 is turned by the user so that the extension portion 66 faces the front of the casing 10. The electric line cord 18 is then wound under the extension portion 66 of the body member 22 and the extension 70 of the fixed cord wrap 68 in a conventional manner.

Accordingly, there has been disclosed an improved front caster assembly for a canister type vacuum cleaner which also serves as part of the cord wrap structure. While a preferred embodiment of the present invention has been disclosed herein, it will be apparent to those of ordinary skill in the art that various modifications and adaptations to that embodiment are possible and it is only intended that the present invention be limited by the scope of the appended claims.

I claim:

1. A caster assembly for a vacuum cleaner casing, comprising:

a body member;

means for mounting said body member on a substantially planar lower surface of said casing, said mounting means being arranged to allow pivoting movement of said body member relative to said casing about an axis transverse to said lower surface;

a caster wheel rotatably mounted on said body member for rolling contact with a floor surface supporting said vacuum cleaner casing, the line of rotation of said caster wheel passing through said pivot axis, the rotational axis of said caster wheel being spaced from said pivot axis and substantially parallel to said lower surface; and a pair of idler wheels rotatably mounted on said body member for rolling contact with said lower surface of said casing, the axes of rotation of said idler wheels being equiangularly spaced on opposite sides of said caster wheel line of rotation and intersecting at said pivot axis;

wherein the improvement comprises said body member being formed with an integral substantially planar extension beyond said caster wheel from said pivot axis, said extension being spaced from and substantially parallel to said lower surface so as to cooperate with the remainder of said body member to provide a wrap tongue for the electric line cord of the vacuum cleaner.

2. The assembly according to claim 1 wherein the angle between the axes of rotation of said idler wheels is about 90 degrees.

3. The assembly according to claim 2 wherein said angle is 84 degrees.

4. The assembly according to claim 1 wherein each of said idler wheels includes an axle and said body member is formed with a plurality of spaced walls formed with axle receiving slots, each of said slots being shaped with sides which taper inwardly to a generally circular region so as to provide for a snap-fit insertion for said idler wheel axles.

* * * * *